US009306352B1

(12) United States Patent
Lin

(10) Patent No.: US 9,306,352 B1
(45) Date of Patent: Apr. 5, 2016

(54) STRING LIGHT CONNECTOR

(71) Applicant: Te-Hui Lin, Zhubei (TW)

(72) Inventor: Te-Hui Lin, Zhubei (TW)

( * ) Notice: Subject to any disclaimer, the term of this patent is extended or adjusted under 35 U.S.C. 154(b) by 0 days.

(21) Appl. No.: 14/601,257

(22) Filed: Jan. 21, 2015

(51) Int. Cl.
*H01R 25/00* (2006.01)
*H01R 4/24* (2006.01)
*H01R 27/02* (2006.01)

(52) U.S. Cl.
CPC ..... *H01R 27/02* (2013.01)

(58) Field of Classification Search
CPC ..... H01R 27/02
USPC ..... 439/638
See application file for complete search history.

(56) References Cited

U.S. PATENT DOCUMENTS 5,989,070 A * 11/1999 Al-Turki ..... F21V 19/006 439/638
7,677,914 B2 * 3/2010 Nall ..... F21V 21/002 362/396
9,099,802 B2 * 8/2015 Beharrell ..... H01R 13/514
2008/0218092 A1 * 9/2008 Chang ..... F21S 4/001 315/185 S
2010/0328953 A1 * 12/2010 Wu ..... F21S 4/001 362/249.14

* cited by examiner

*Primary Examiner* — Tulsidas C Patel
*Assistant Examiner* — Peter G Leigh
(74) *Attorney, Agent, or Firm* — Leong C. Lei

(57) ABSTRACT

The connector has a base with hooked side boards for joining a top cap. A partition board is placed between the side boards so as to form two slots for housing two metallic plates and two supporting pieces with slant top faces. The metallic plates have two upwardly extended conducting pins. Wires of exposed cores are placed on the supporting pieces. When the top cap is joined to the base, the wires are tightly locked by the top cap and the partition board while the conducting pins firmly contact with the cores. The connector can be quickly configured on a string of lamps and can be conveniently used to cascade multiple strings of lamps.

5 Claims, 6 Drawing Sheets

STRING LIGHT CONNECTOR

BACKGROUND OF THE INVENTION (a) Technical Field of the Invention

The present invention is generally related to string lights, and more particular to a connector for cascading string lights.

(b) Description of the Prior Art

To the inventor's knowledge, the manufacturing of conventional Christmas string lights involves a stage of welding or clamping wires of a string light to the prongs of a plug. This stage is usually conducted after the lamps of the string light are installed. In other words, a worker usually has to carry dangling strands of lamps, manually perform the welding or clamping, and then carry the string light to a next stage where a casing for the plug is put on. This process not only is troublesome, but also is time-consuming and laborious.

SUMMARY OF THE INVENTION

A novel connector is provided herein so as to obviate the shortcomings of the prior art. According to the present invention, the installation of the connector can be conducted along with the installation of the lamps of a string light by an automated machine. The automated machine will strip the wires of the string light and put on the connector in a single operation. There is no need to carry the string light around to conduct various installation tasks, thereby saving a considerable amount of time and effort wasted on manual welding and clamping and as such achieving enhanced production efficiency.

The connector contains a base, two metallic plates, a suppression board, and a top cap. The base has a bottom board, two side boards extended upward from two opposing edges on a top side of the bottom board, a partition board positioned between and parallel to the opposing side boards, and two supporting pieces in two slots formed between the partition board and the side boards. Each side board has a hook section on a top edge protruding outward, each supporting piece has an inwardly slant face along a top edge, each slot has an open front end and an open top side, the partition board has front and back sections, and three protrusions extended upward from a top edge, two on the front and back sections and one in the middle. Each metallic plate is housed in a slot with a front section extended forward outside the base and has a conducting pin extended upward from a middle section. The suppression board has three through openings, allowing the three protrusions of the partition board to pass through. The top cap has an open bottom, two openings along two opposing top edges, and two indentations along a front side and a back side, respectively.

The assembly of the connector is as follows. The two metallic plates are placed in the slots, respectively, each with a front section extended from a front side of the base. The suppression board is then placed on top of the base so as to seal the slots. A cable has two wires with a section of their plastic sheathes removed so that their cores are exposed. The exposed cores is placed on the slant faces of the support pieces, respectively. The top cap is then joined to the base by the side boards' hooks locking the openings of the top cap, respectively. In the meantime, a bottom edge of the front and back indentations forcing the cable to bend between the indentations and the protrusions of the front and back sections, and the cores tightly contact the conducting pins of the metallic plates.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
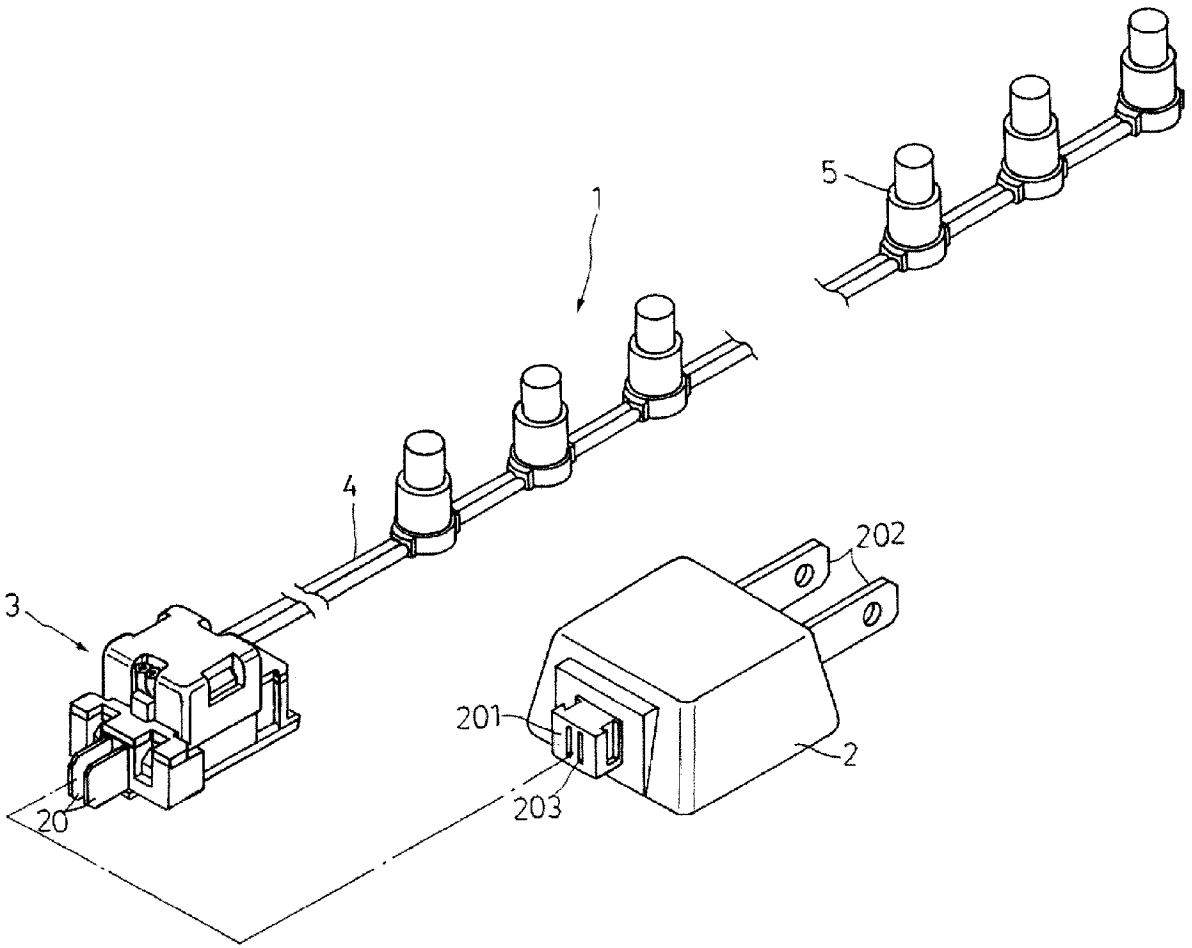
FIG. 1 is a perspective diagram showing a string light configured with a connector according to a first embodiment of the present invention.
Figure 2:
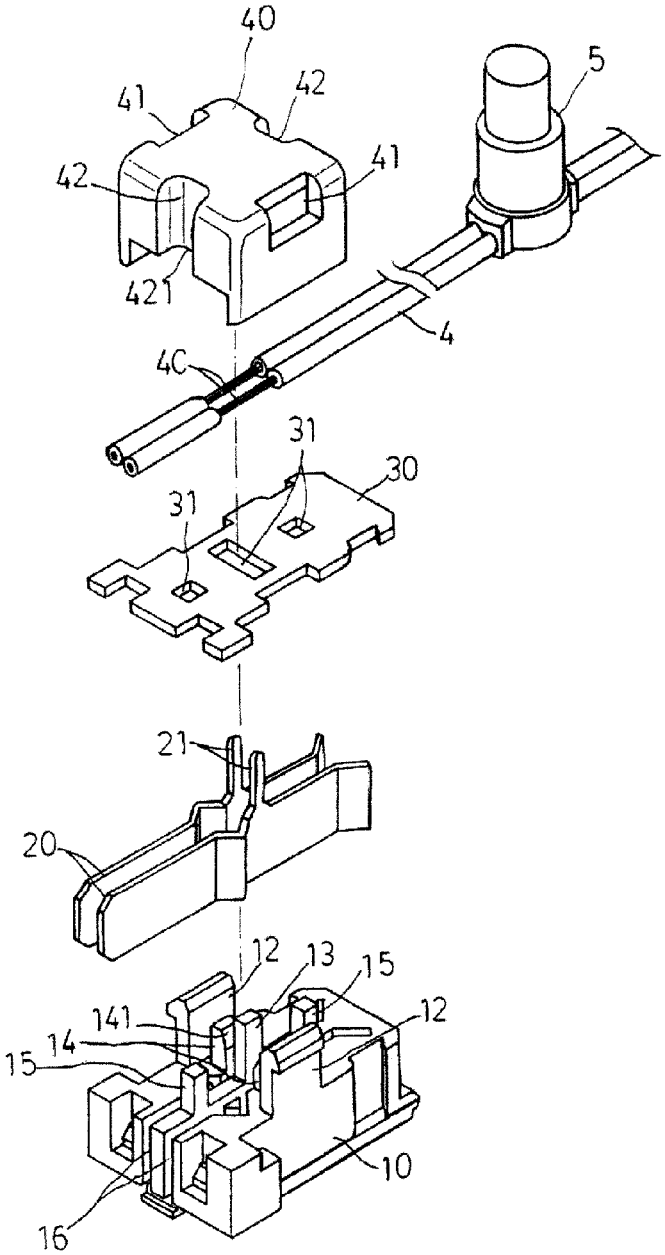
FIG. 2 is a perspective break-down diagram showing the various components of the connector of FIG. 1.
Figure 3:
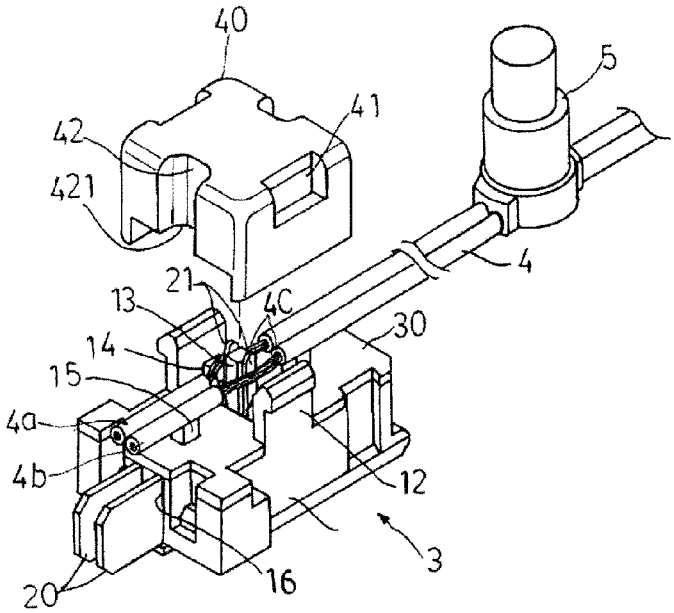
FIG. 3 shows a connector of FIG. 1 partially assembled.

As shown in FIG. 1, a string light 1 where a connector 3 according to an embodiment of the present invention is installed further contains a cable 4, a number of LED lamps 5 configured along the cable 4, and a plug 2. The connector 3 is configured at an end of the cable 4 and has metallic plates 20 projecting from a front side of the connector 3. The plug 2 has prongs 202 extended from a front side of the plug 2 for plugging into a wall socket, and sockets 203 on a back side for receiving the metallic plates 20 of the connector 3.

As shown in FIGS. 2 to 5, the connector 3 contains a base 10, two elongated metallic plates 20, a suppression board 30, and a top cap 40. The base 10 has a bottom board and two side boards 12 extended upward from two opposing edges on a top side of the bottom board, respectively. Each side board 12 has a hook section on a top edge protruding outward. The base 10 further has a partition board 13 positioned between and parallel to the opposing side boards 12. The partition board 13 has front and back sections 15. As such two slots 16 are formed between the side boards 12 and the partition board 13.

Each slot 16 has an open front end and an open top side. A supporting piece 14 having an inwardly slant face 141 along a top edge is configured within each slot 16. Each metallic plate 20 has a conducting pin 21 extended upward from a middle section of the metallic plate 20. The partition board 13 has three protrusions extended upward from a top edge, two on the front and back sections 15, respectively, and one in the middle. The suppression board 30 has three through openings 31, allowing the three protrusions of the partition board 13 to pass through. The top cap 40 has an open bottom, two openings 41 along two opposing top edges, and two indentations 42 along a front side and a back side, respectively.

Figure 4:
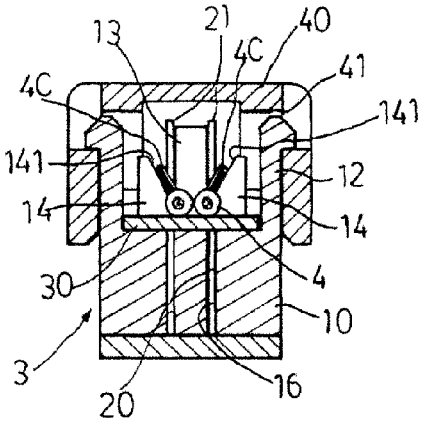
FIG. 4 is a cross-sectional diagram showing the connector of FIG. 1 after its assembly.
Figure 5:
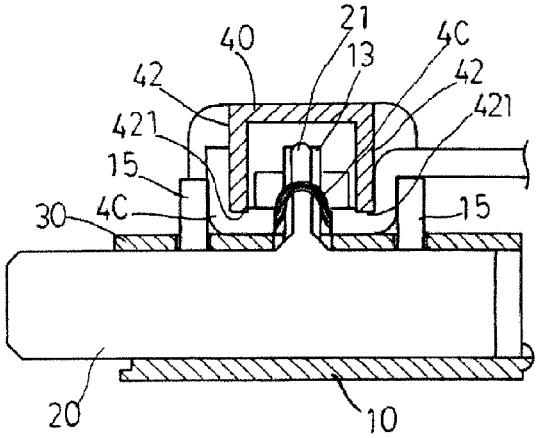
FIG. 5 is a sectional diagram showing the connector of FIG. 1 after its assembly.

The connector 3 is assembled to a front end of the cable 4 when the LED lamps 5 are installed on the cable 4, both by an automated machine. The assembly of the connector 3 is as follows. The two metallic plates 20 are placed in the slots 16, respectively, and each metallic plate 20 has a front section extended from a front side of the base 10. The suppression board 30 is then placed on top of the base 10 so as to seal the slots 16. The cable 4 has two wires 4*a* and 4*b*, and the wires 4*a* and 4*b* has a section of their plastic sheathes removed so that their cores 4*c* are exposed by the automated machine. The exposed cores 4*c* are placed on the slant faces 141 of the support pieces 14, respectively. The top cap 40 is then joined to the base 10 by the side boards 12's hooks locking the openings 41 of the top cap 40, respectively. In the meantime, a bottom edge 421 of the front and back indentations 42 forcing the cable 4 to bend between the indentations 42 and the protrusions of the front and back sections 15, as shown in FIG. 5, where the cable 4 is as such more robust against outside pull. As the cable 4 is bended as described, the cores 4*c* slide downward along the slant faces 141 and tightly contact the conducting pins 21 of the metallic plates 20, as shown in FIG. 4. The connector 3's installation to the cable 4 is then completed. Please note that on a back side of the connector 3, there are two sockets 101 (see FIG. 8) exposing the metallic pins 20's back ends.

Figure 6:
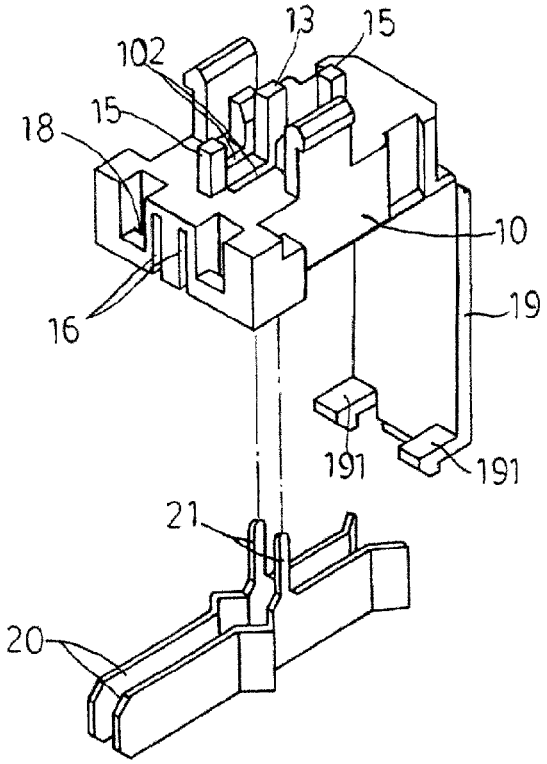
FIGS. 6 and 7 are perspective diagrams showing a connector according to a second embodiment of the present invention partially assembled.
Figure 7:
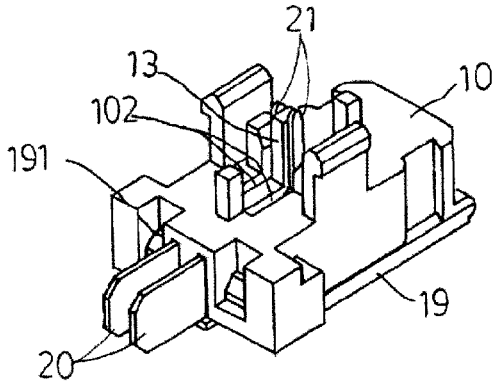

FIGS. 6 and 7 show another embodiment of the connector 3. As illustrated, each slot 16 has an open front end and an open bottom side. The metallic plates 20 are placed in the slots 16 from below. A top side of the base 10 functions as the suppression board 30 of the previous embodiment. The top side has two additional openings 102 exposing the slots 16 between the side boards 12 and the partition board 13 so that the conducting pins 21 can pass through. The front side of the base 10 has two indentations 18 and the front ends of the slots 16 are located between the two indentations 18. A bottom back edge of the base 10 is hinged with a flipable bottom cover 19. A front edge of the bottom cover 19 is configured with two locking elements 191 with hooks. After the metallic plates 20 are placed in the slots 16, each metallic plate 20 has a front section extended from the front side of the base 10, and the conducting pins 21 protrude outside the base 10, each to a side of the partition board 13. The bottom cover 19 is then flipped to tightly seal the bottom side of the base 10 by forcing the locking elements 191 into the two indentations 18.

Figure 8:
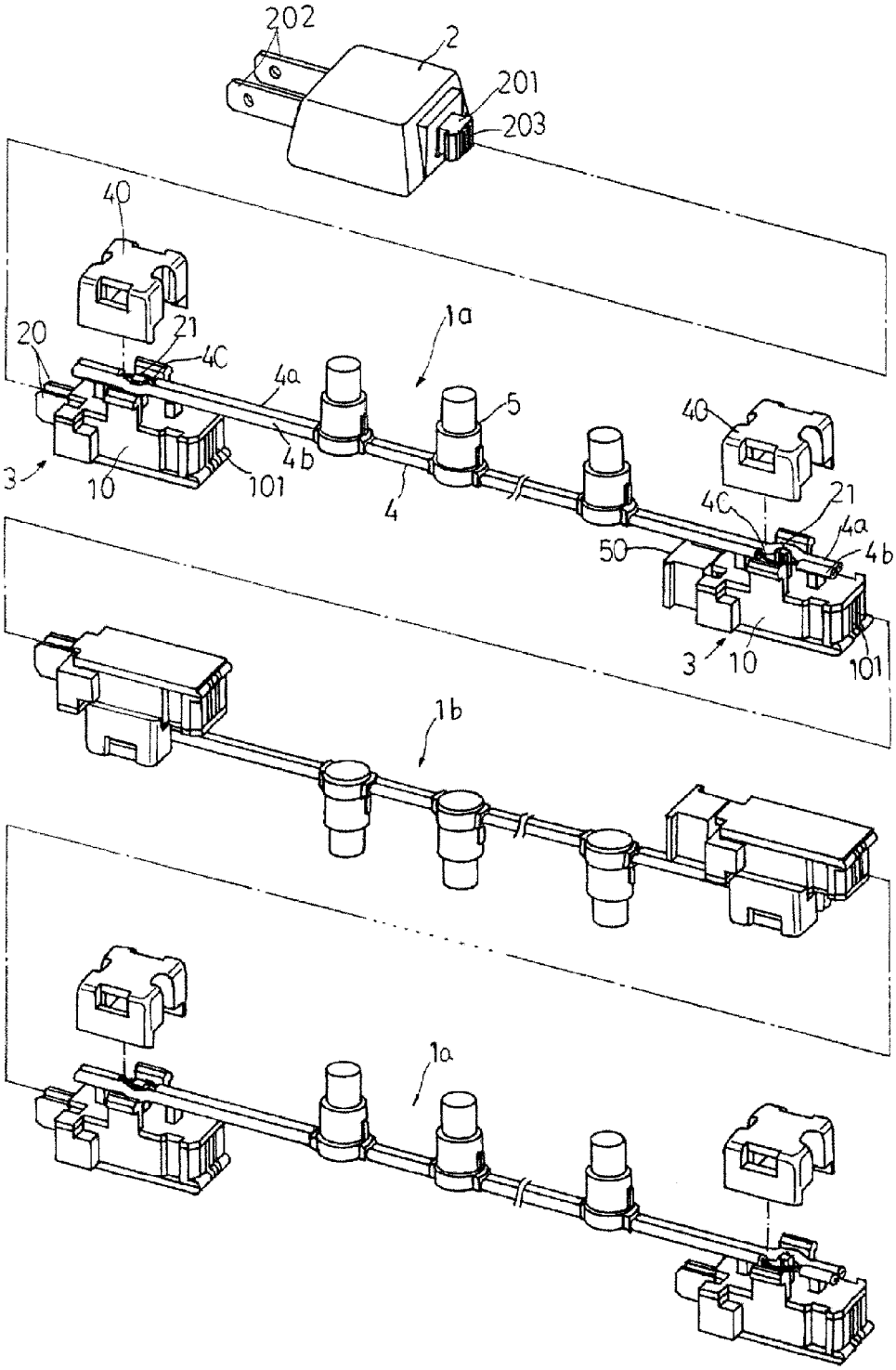
FIG. 8 shows an application scenario cascading a number of string lights configured with connectors according to the present invention.

FIG. 8 depicts an application scenario of the present invention where strings of more than 50 LED lamps 5 are cascaded. Usually for that many LED lamps 5, the LED lamps 5 near the end of a string would be less bright, and people often connect the LED lamps 5 in parallel first, and then in series. However, for LED lamps 5 requiring DC electricity with positive and negative polarities, cascading the string lights usually requires that the LED lamps 5 on alternate strings have to be connected in a reversed manner. This process easily leads to mistakes. The connector 3 of the present invention can easily overcome this problem.

As shown in FIG. 8, a string light having 50 LED lamps 5 has connectors 3 of the present invention configured on a front end and a back end, respectively. For a front connector 3 on the front end, the cable 4 has only one of the wires, say 4*a*, exposing the core 4*c* and as such only the wire 4*a* has the core 4*c* contacting a first conducting pin 21 of the connector 3. On the other hand, as to a back connector 3 on the back end, the cable 4 has only the other wire 4*b* exposing the core 4*c* and only the wire 4*b* has the core 4*c* contacting a second conducting pin 21 of the connector 3. In alternative scenarios, a connector 3 can be configured at any location along the cable 4.

To cascade a number of light strings, a first light string 1*a* has its front connector 3's metallic plates 20 plugged into the sockets 203 on a socket base 201 of the plug 2. A second light string 1*b* is flipped upside down and has its front connector 3's metallic plates 20 plugged into the sockets 101 on the back side of the back connector 3 on the first string light 1*a*. A third string light 1*c* is cascaded to the second string 1*b* similarly but the third string light 1*c* has the same orientation as the first string light 1*a*. In other words, if counting from the plug 2, odd-numbered string lights are oriented as the light string 1*a* whereas even-numbered string lights are oriented as the light string 1*b*. For those connectors 3 whose metallic plates 20 are not used, a protective cap 50 can be used to conceal and protect the idle metallic plates 20.

With the present invention, the connectors on the front and back ends of each string light are configured identically. To cascade multiple string lights, all is required is to flip alternate string lights 180 degrees and then end-to-end connect the light strings together. There is little chance to make mistakes.

Figure 9:
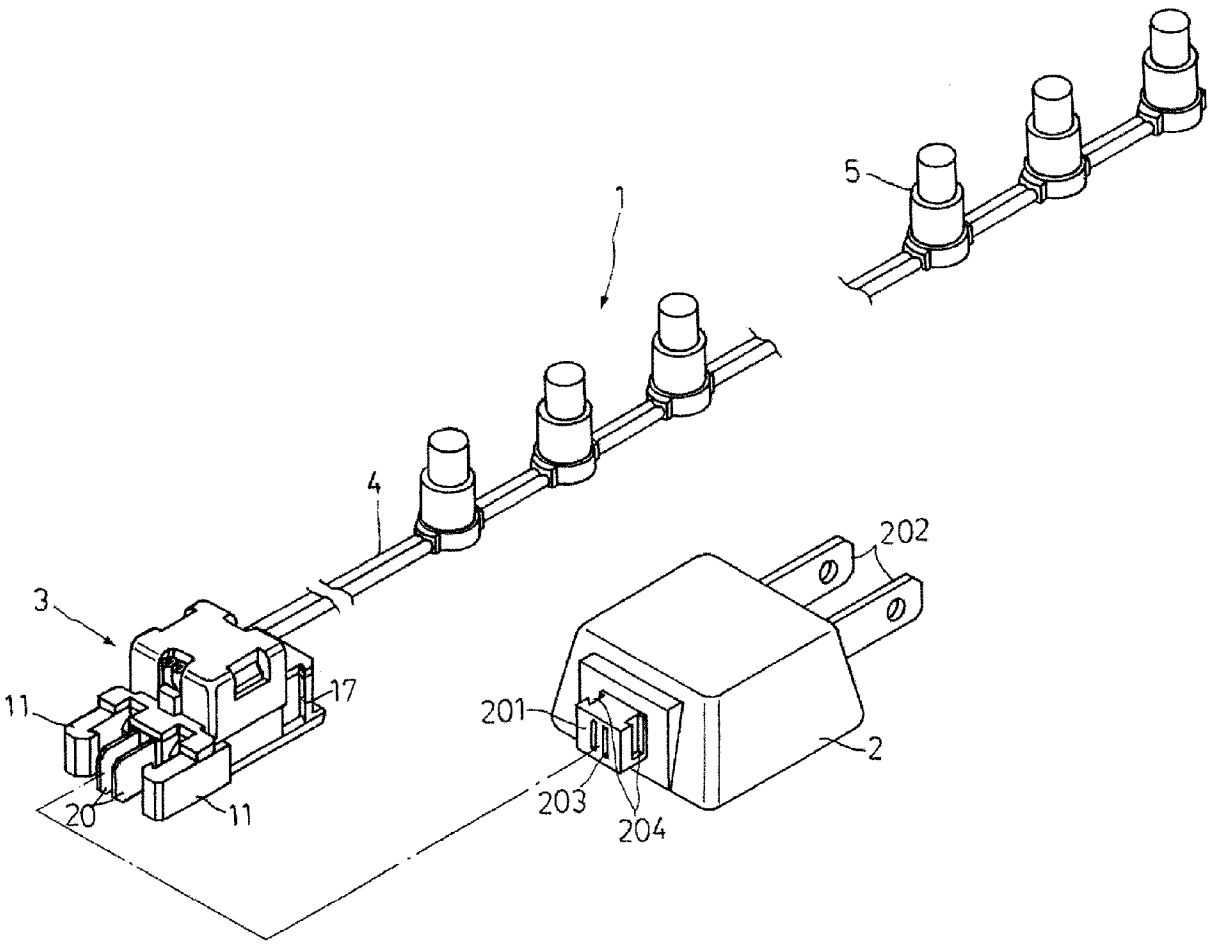
FIG. 9 is a perspective diagram showing a string light configured with a connector according to a third embodiment of the present invention.

FIG. 9 shows a string light 1 where a connector 3 according to yet another embodiment of the present invention is installed. The string light 1 contains a cable 4, a number of LED lamps 5 configured along the cable 4, and a plug 2. The connector 3 is identical the first embodiment but has two arms 11 having hooks on their front ends extended forward from the front side of the base 10. The metallic pins 20 are located between the arms 11. The plug 2 has prongs 202 extended from a front side of the plug 2 for plugging into a wall socket, and sockets 203 on a back side for receiving the metallic plates 20 of the connector 3. The sockets 203 is configured on a socket base 201 whose two opposing sides have notches 204, respectively, for locking with the arms 11's hooks.

Similarly, flanges 17 are extended laterally from two opposing edges of the back side of each connector 3's base 10 so that, when a second string light is cascaded to a first string light, the second string light's front connector 3 has its arms 11 locking with the flanges 17 on the back connector 3 of the first string light.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A connector for a string light having a plurality of lamps on a cable of two wires, comprising:

a base has a bottom board, two side boards extended upward from two opposing edges on a top side of the bottom board, a partition board positioned between and parallel to the opposing side boards, and two supporting pieces in two slots formed between the partition board and the side boards, where each side board has a hook section on a top edge protruding outward, each supporting piece has an inwardly slant face along a top edge, each slot has an open front end and an open top side, the partition board has front and back sections, and three protrusions extended upward from a top edge, two on the front and back sections and one in the middle;

two metallic plates, each housed in a slot with a front section extended forward outside the base and having a conducting pin extended upward from a middle section;

a suppression board having three through openings, allowing the three protrusions of the partition board to pass through; and a top cap having an open bottom, two openings along two opposing top edges, and two indentations along a front side and a back side, respectively;

wherein the two metallic plates are placed in the slots, respectively, and each metallic plate has a front section extended from a front side of the base; the suppression board is then placed on top of the base so as to seal the slots; the wires of the cable has a section of their plastic sheathes removed so that their cores are exposed; the exposed cores are placed on the slant faces of the support pieces, respectively; the top cap is then joined to the base by the side boards' hooks locking the openings of the top cap, respectively; in the meantime, a bottom edge of the front and back indentations forces the cable to bend between the indentations and the protrusions of the front and back sections while the cores slide downward along the slant faces and tightly contact the conducting pins of the metallic plates.

2. A connector for a string light having a plurality of lamps on a cable of two wires, comprising:

a base has two indentations on a front side, two side boards extended upward from two opposing edges on a top side, two slots having open front ends and open bottom sides whose front ends are between the two indentations, a partition board between the slots, and two supporting pieces extended upward from the top side between the side boards, where each side board has a hook section on a top edge protruding outward, each supporting piece an inwardly slant face along a top edge, and three protrusions extended upward from the top side, and the top side has two openings connecting the slots between the supporting pieces;

two metallic plates, each housed in a slot with a front section extended forward outside the base and having a conducting pin extended upward from a middle section through the top sides' slots;

a top cap having an open bottom, two openings along two opposing top edges, and two indentations along a front side and a back side, respectively; and a bottom cover hinged with a bottom back edge of the base, a front edge of the bottom cover configured with two locking elements with hooks;

wherein the two metallic plates are placed in the slots, respectively, and each metallic plate has a front section extended from a front side of the base; the wires of the cable has a section of their plastic sheathes removed so that their cores are exposed; the exposed cores are placed on the slant faces of the support pieces, respectively; the top cap is then joined to the base by the side boards' hooks locking the openings of the top cap, respectively; in the meantime, a bottom edge of the front and back indentations forces the cable to bend between the indentations and the protrusions of the front and back sections while the cores slide downward along the slant faces and tightly contact the conducting pins of the metallic plates; and the bottom cover is flipped to tightly seal the bottom side of the base by forcing the locking elements into the two indentations of the base.

3. The connector according to claim 1, wherein the connector is installed at an end of the cable or a place along the cable of the light string.

4. The connector according to claim 3, wherein for a front connector on a front end of the cable, the cable has only a first wire exposing a core and as such only the first wire has the core contacting a first conducting pin; and, for a back connector on a back end, the cable has only a second wire exposing the core and only the second wire has a core contacting a second conducting pin.

5. The connector according to claim 1, wherein the base has two arms extended forward from a front side with the metallic pins located in between and two flanges extended laterally from two opposing edges of the back side of the base.

* * * * *